US006324256B1

(12) United States Patent
McGregor et al.

(10) Patent No.: US 6,324,256 B1
(45) Date of Patent: Nov. 27, 2001

(54) LIQUID SPRAYS AS THE TARGET FOR A LASER-PLASMA EXTREME ULTRAVIOLET LIGHT SOURCE

(75) Inventors: Roy D. McGregor, El Camino Village; Michael B. Petach, Redondo Beach; Rocco A. Orsini, Long Beach, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/644,589

(22) Filed: Aug. 23, 2000

(51) Int. Cl.[7] ..... H05H 1/24
(52) U.S. Cl. ..... 378/119
(58) Field of Search ..... 378/119, 120, 378/143; 372/5

(56) References Cited

U.S. PATENT DOCUMENTS 4,723,262 * 2/1988 Noda et al. ..... 378/119
5,577,092 11/1996 Kublak et al. .
6,002,744 * 12/1999 Hertz et al. ..... 378/119
6,007,963 12/1999 Felter et al. .

* cited by examiner

*Primary Examiner*—David P. Porta
*Assistant Examiner*—Jurie Yun
(74) *Attorney, Agent, or Firm*—Harness, Dickey & Pierce, P.L.C.

(57) ABSTRACT

A laser-plasma EUV radiation source (50) that generates larger liquid droplets (72) for the plasma target material. The EUV source (50) forces a liquid (58), preferably Xenon, through a nozzle (64), instead of forcing a gas through the nozzle. The geometry of the nozzle (64) and the pressure of the liquid (58) through the nozzle (64) atomizes the liquid (58) to form a dense spray (70) of droplets (72). Because the droplets (72) are formed from a liquid, they are larger in size, and are more conducive to generating EUV radiation. A condenser (60) is used to convert gaseous Xenon (54) to the liquid (58) prior to being forced through the nozzle (64).

8 Claims, 2 Drawing Sheets

LIQUID SPRAYS AS THE TARGET FOR A LASER-PLASMA EXTREME ULTRAVIOLET LIGHT SOURCE

BACKGROUND OF THE INVENTION

1. Field of the Invention

This invention relates generally to an extreme ultraviolet light source, and more particularly, to a laser-plasma, extreme ultraviolet light source for a photolithography system that employs a liquid spray as the target material for generating the laser plasma.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths and higher frequencies. In other words, the resolution of the photolithography process increases as the wavelength of the light source decreases to allow smaller integrated circuit elements to be defined. The current state of the art for photolithography light sources generate light in the extreme ultraviolet (EUV) or soft x-ray wavelengths (13.4 nm).

Different devices are known in the art to generate EUV radiation. One of the most popular EUV light sources is a laser-plasma, gas condensation source that uses a gas, typically Xenon, as a laser plasma target material. Other gases, such as Krypton, and combinations of gases, are known for the laser target material. The gas is forced through a nozzle, and as the gas expands, it condenses and forms a cloud or jet of extremely small particles known in the art as clusters. The condensation of cluster jet is illuminated by a high-power laser beam, typically from a Nd:YAG laser, that heats the clusters to produce a high temperature plasma which radiates the EUV radiation. U.S. Pat. No. 5,577,092 issued to Kublak discloses an EUV radiation source of this type.

FIG. 1 is a plan view of an EUV radiation source 10 including a nozzle 12 and a laser beam source 14. FIG. 2 is a close-up view of the nozzle 12. A gas 16 flows through a neck portion 18 of the nozzle 12 from a gas source (not shown), and is accelerated through a narrowed throat portion 20 of the nozzle 12. The accelerated gas 16 then propagates through a flared portion 24 of the nozzle 12 where it expands and cools, and is expelled from the nozzle 12. As the gas cools and condenses, it turns into a jet spray 26 of clusters 28.

A laser beam 30 from the source 14 is focused by focusing optics 32 on the clusters 28. The heat from laser beam 30 generates a plasma 34 that radiates EUV radiation 36. The nozzle 12 is designed so that it will stand up to the heat and rigors of the plasma generation process. The EUV radiation 36 is collected by collector optics 38 and is directed to the circuit (not shown) being patterned. The collector optics 38 can have any suitable shape for the purposes of collecting the radiation 36, such as a parabolic shape. In this design, the laser beam 30 propagates through an opening 40 in the collector optics 38.

The laser-plasma EUV light source discussed above suffers from a number of drawbacks. Particularly, it is difficult to produce a sufficiently large droplet spray or large enough droplets of liquid to achieve the desirable efficiency of conversion of the laser radiation to the EUV radiation. Because the clusters 28 have too small a diameter, and thus not enough mass, the laser beam 30 causes some of the clusters 28 to break-up before they are heated to a sufficient enough temperature to generate the EUV radiation 36. Typical diameters of the droplets generated by a gas condensation EUV source are less than 0.01 microns and it is exceedingly difficult to produce clusters that are significantly larger than 0.1 microns. However, particle sizes of about one micron in diameter would be more desirable for generating the EUV radiation. Additionally, the large degree of expansion required to maximize the condensation process produces a diffuse cloud or jet of clusters, and is inconsistent with the optical requirement of a small plasma size.

What is needed is a laser-plasma EUV radiation source that is able to generate larger droplets of liquid to enhance the EUV radiation generation. It is therefore an object of the present invention to provide such an EUV radiation source.

SUMMARY OF THE INVENTION

In accordance with the teachings of the present invention, a laser-plasma EUV radiation source is disclosed that generates larger liquid droplets for the plasma target material than previously known in the art. The EUV source forces a liquid, preferably Xenon, through the nozzle, instead of forcing a gas through the nozzle. The geometry of the nozzle and the pressure of the liquid propagating though the nozzle atomizes the liquid to form a dense spray of liquid droplets. Because the droplets are formed from a liquid, they are larger in size, and are more conducive to generating the EUV radiation. A heat exchanger is used to convert gaseous Xenon to the liquid Xenon prior to being forced through the nozzle.

Additional objects, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a laser-plasma extreme ultraviolet radiation source using a liquid laser target material is merely exemplary in nature, and is in no way intended to limit the invention or its application or uses.

Figure 1:
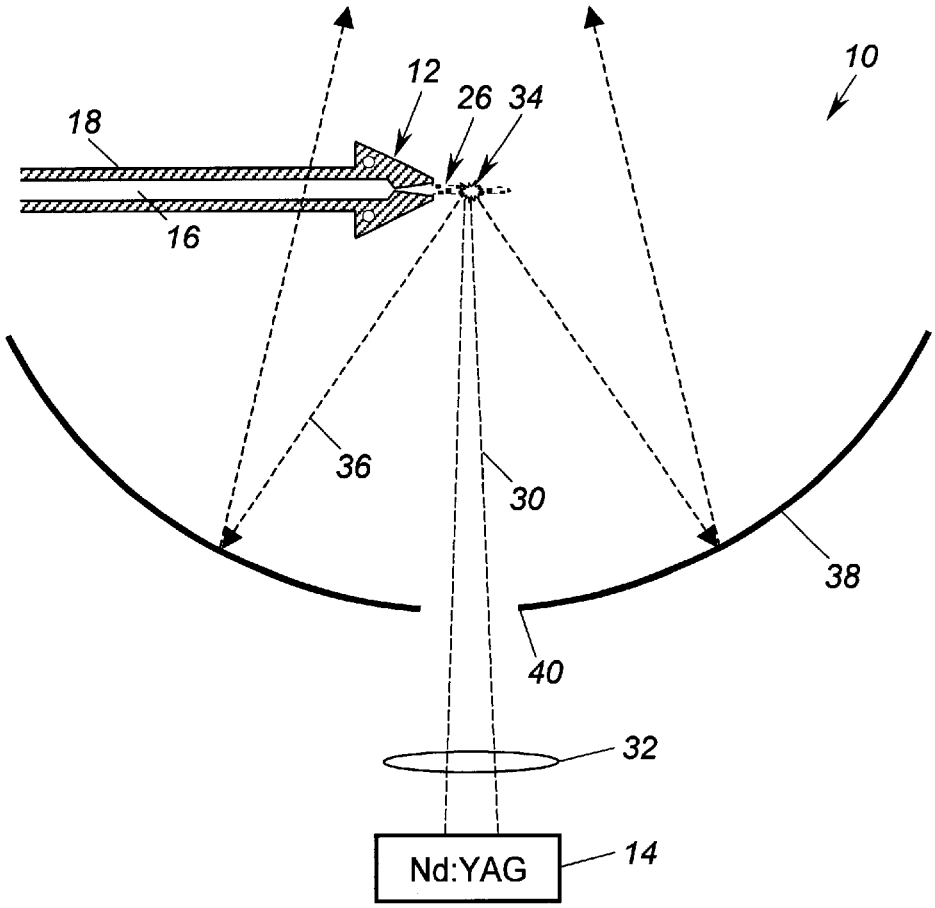
Figure 1 (Prior Art)
FIG. 1 is a plan view of a known laser-plasma, gas condensation, extreme ultraviolet light source.
Figure 2:
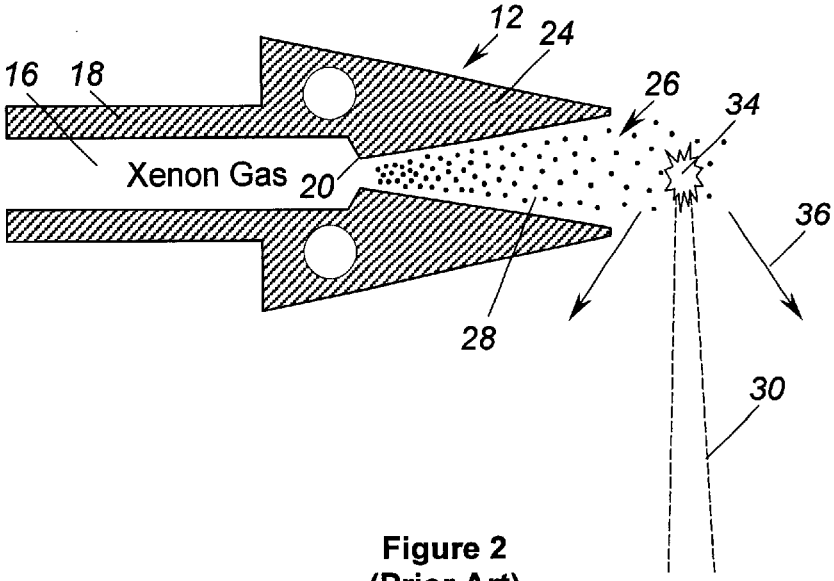
Figure 2 (Prior Art)
FIG. 2 is a close-up view of the nozzle of the source shown in FIG. 1.
Figure 3:
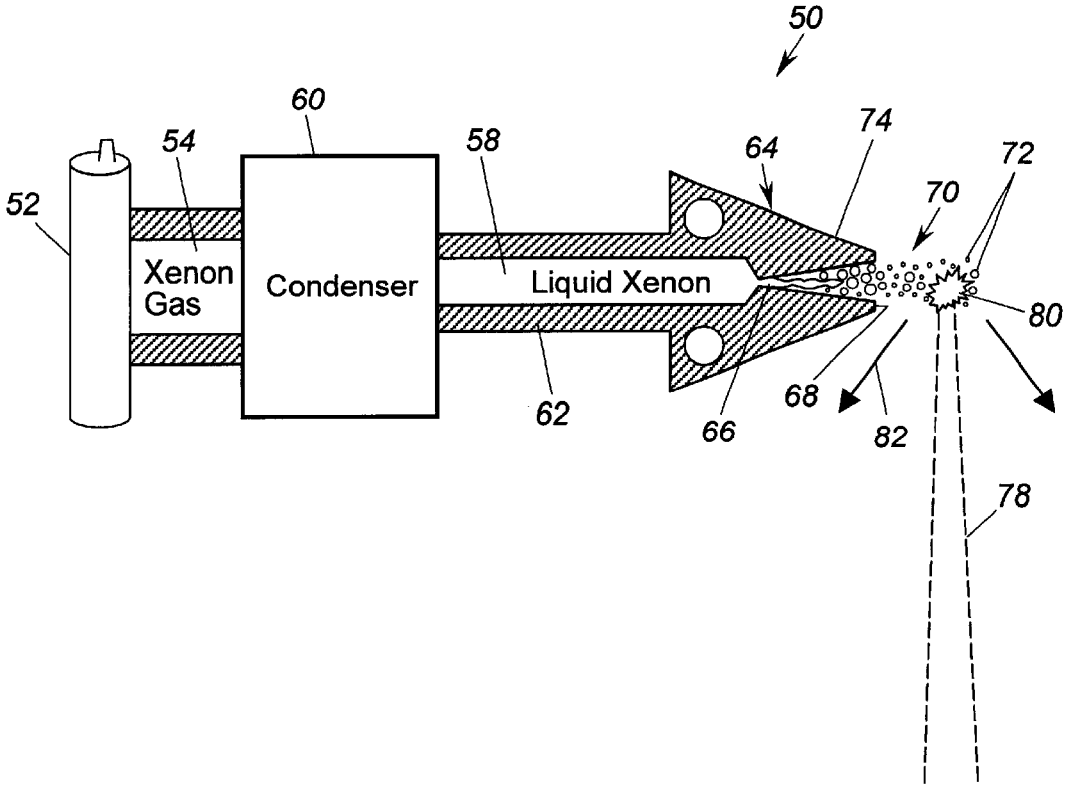
FIG. 3 is a plan view of a laser-plasma, extreme ultraviolet radiation source including liquid injected through a nozzle, according to an embodiment of the present invention.

FIG. 3 is a plan view of a laser-plasma EUV radiation source 50, according to an embodiment of the present invention. The source 50 has particular application in a photolithography device for patterning integrated circuits, but as will be appreciated by those skilled in the art, may have other applications as a EUV source or soft x-ray source. The system 50 includes a supply 52 of a suitable plasma target gas 54, such as Xenon or Krypton. Because these gases occur naturally in a gaseous state, a heat exchanger 60 is employed to reduce the temperature of the gas 54 and thereby convert the gas 54 to a liquid 58. The liquid 58 is then forced through a neck portion 62 of a nozzle 64.

The nozzle 64 includes a narrowed throat portion 66. The pressure and flow rate of the liquid 58 through the throat portion 66 and the configuration of the nozzle 64 causes a spontaneous break-up of the liquid 58 to form a dense spray 70 of liquid droplets 72 as the liquid 58 propagates through a flared portion 74 of the nozzle 64. In this embodiment, the throat portion 66 has a circular cross section and the flared portion 74 has a conical shape. However, in alternate embodiments, these shapes may be different and may, for example, include a sudden expansion downstream of the throat 66. In one embodiment, the diameter of the throat portion 66 is about 50 microns in diameter and the diameter of an exit end 68 of the nozzle 64 is between 300 and 500 microns in diameter.

A laser source generates a laser beam 78 that propagates towards the droplets 72. A plasma 80 is generated by the interaction between the laser beam 78 and the droplets 72. The plasma 80 generates EUV radiation 82 that is collected by collector optics that directs the EUV radiation towards focusing optics (not shown). Because the droplets 72 are larger in diameter than the droplets formed by the conventional gas condensation laser plasma source, they provide a greater laser-to-EUV energy conversion. In one embodiment, the average diameter of the droplet 72 is about one micron.

The break-up of the liquid 58 in the nozzle 64 occurs spontaneously through one or more of a number physical processes which are collectively known as atomization. The liquid 58 breaks up into a large number of the droplets 72 which are individually much smaller than the laser spot size, but collectively form a dense cloud that serves as the laser target. The individual processes include, but are not necessarily limited to, cavitation, boiling, viscoelastic instabilities on liquid surfaces, turbulent break-up, and aerodynamic interaction between the liquid and its evolved vapor.

By optimizing the nozzle geometry and flow conditions of the liquid 58, the desired concentration of appropriately sized droplets can be provided at a more favorable distance from the nozzle end 68 to help reduce the damage to the nozzle 64 from the plasma generation process. The geometry of the prior-art gas condensation nozzle is such that the laser beam impinges the droplets close to the end of the nozzle. This caused heating and erosion of the nozzle as a result of this process. Further, for the known gas condensation sources, the nozzle had to be significantly larger to provide large enough droplets to generate the EUV radiation. Because of this large size, the nozzle actually obscured some of the EUV radiation that could otherwise have been collected.

In the present invention, because the desired mass of the droplets 72 can be achieved through the smaller flared portion 74, the actual size of the nozzle 64 can be reduced. The smaller nozzle obscures less of the EUV radiation. Further, the laser beam 78 can be moved farther from the end 68 of the nozzle 64, thus reducing the erosion and heating of the nozzle 64.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A laser-plasma extreme ultraviolet (EUV) radiation source comprising:

a target supply system providing a liquid plasma target material, wherein the target supply system includes a supply of the target material in a gaseous state and a heat exchanger, said heat exchanger reducing the temperature of the gas to condense it into a liquid;

a nozzle including a source end, an exit end, and a narrowed throat section therebetween, said source end receiving the liquid from the target supply system, said nozzle emitting liquid droplets through the exit end; and a laser beam source emitting a laser beam towards the liquid droplets, said laser beam heating the liquid droplets and generating EUV radiation.

2. The source according to claim 1 wherein the nozzle further includes an expanded portion between the throat section and the exit end, said liquid droplets being formed in said expanded section downstream of the throat.

3. The source according to claim 1 wherein the liquid is a Xenon liquid.

4. A laser-plasma extreme ultraviolet light source for generating EUV radiation for a photolithography system, said source comprising:

a gas supply of a plasma target material;

a heat exchanger receiving the gas from the gas supply, said heat exchanger cooling the gas to convert the gas to a liquid plasma target material;

a nozzle including a neck portion, a narrowed throat portion, an expanded portion and an exit end, said neck portion receiving the liquid plasma target material from the heat exchanger and forcing the liquid target material through the narrowed throat section, said nozzle emitting a spray of liquid droplets through the exit end; and a laser beam source emitting a laser beam towards the liquid droplet spray, said laser beam heating the liquid droplet spray and generating the EUV radiation.

5. The source according to claim 4 wherein the liquid is a Xenon liquid.

6. A method of generating extreme ultraviolet radiation, said method comprising the steps of:

providing a supply of a liquid target material including chilling a target gas;

forcing the liquid target material through a narrowed throat section in a nozzle;

atomizing the liquid target material into a droplet spray exiting from the nozzle; and interacting a laser beam with the liquid droplets to generate the EUV radiation.

7. The method according to claim 6 wherein the step of providing the liquid target material includes chilling a Xenon gas.

8. The method according to claim 6 wherein the step of atomizing the liquid target material includes expanding the liquid in an expanded portion of the nozzle.

* * * * *